US011032643B2

(12) United States Patent
Harris

(10) Patent No.: US 11,032,643 B2
(45) **Date of Patent: *Jun. 8, 2021**

(54) DISTRIBUTED MODE LOUDSPEAKER ACTUATOR INCLUDING PATTERNED ELECTRODES

(71) Applicant: Google LLC, Mountain View, CA (US)

(72) Inventor: Neil John Harris, Los Altos, CA (US)

(73) Assignee: Google LLC

( * ) Notice: Subject to any disclaimer, the term of this patent is extended or adjusted under 35 U.S.C. 154(b) by 0 days.

This patent is subject to a terminal disclaimer.

(21) Appl. No.: 16/833,916

(22) Filed: Mar. 30, 2020

(65) Prior Publication Data

US 2020/0336828 A1 Oct. 22, 2020

Related U.S. Application Data

(63) Continuation of application No. 16/510,740, filed on Jul. 12, 2019, now Pat. No. 10,631,089, which is a (Continued)

(51) Int. Cl.
*H04R 3/04* (2006.01)
*H04R 17/00* (2006.01)

(Continued)

(52) U.S. Cl.
CPC ..... *H04R 3/04* (2013.01); *H04R 1/24* (2013.01); *H04R 7/06* (2013.01); *H04R 17/00* (2013.01);

(Continued)

(58) Field of Classification Search
CPC .... H04R 7/06; H04R 17/00; H04R 2307/023; H04R 2499/15; H04R 3/04; H04R 1/24;

(Continued)

(56) References Cited

U.S. PATENT DOCUMENTS 6,137,890 A 10/2000 Markow
6,324,052 B1 11/2001 Azima et al.

(Continued)

FOREIGN PATENT DOCUMENTS

CN 101385390 3/2009
CN 101405090 4/2009

(Continued)

OTHER PUBLICATIONS

'simeoncanada.com' [online] "Nxttechnology review.01," Available on or before Mar. 4, 2017, [retrieved on Dec. 13, 2017] Retrieved from Internet: URL< https://simeoncanada.com/wp-content/uploads/RandI3.pdf> 32 pages.

(Continued)

*Primary Examiner* — David L Ton
(74) *Attorney, Agent, or Firm* — Fish & Richardson P.C.

(57) ABSTRACT

Methods, systems, and apparatus, including computer programs encoded on computer storage media, for selecting distributed mode loudspeaker electrodes using an output frequency. One of the methods includes determining, for a piezoelectric transducer, a subset of frequencies, from a range of frequencies, at which to output a sound; selecting, based on the subset of frequencies, one or more electrode pairs from two or more electrode pairs included in the piezoelectric transducer to generate the sound; and providing, by a drive module connected to each of the two or more electrode pairs, current to each of the selected one or more electrode pairs to cause the piezoelectric transducer to generate a force that, when provided to a load, causes the load to generate the sound within the subset of frequencies.

16 Claims, 3 Drawing Sheets

Device Perspective View

Device Side View

Related U.S. Application Data continuation of application No. 15/840,232, filed on Dec. 13, 2017, now Pat. No. 10,356,523.

(51) Int. Cl.

| | |
|---|---|
| ***H04R 7/06*** | (2006.01) |
| ***H04R 1/24*** | (2006.01) |
| ***H04R 7/04*** | (2006.01) |

(52) U.S. Cl.

CPC ..... *H04R 7/045* (2013.01); *H04R 2307/023* (2013.01); *H04R 2430/03* (2013.01); *H04R 2499/11* (2013.01); *H04R 2499/15* (2013.01)

(58) Field of Classification Search

CPC . H04R 7/045; H04R 2430/03; H04R 2499/11
See application file for complete search history.

(56) References Cited

U.S. PATENT DOCUMENTS

| | | | |
|---|---|---|---|
| 6,324,294 | B1 | 11/2001 | Azima et al. |
| 6,584,206 | B2 | 6/2003 | Ohashi |
| 7,149,318 | B2 | 12/2006 | Bank et al. |
| 7,475,598 | B2 | 1/2009 | Starnes et al. |
| 7,684,576 | B2 | 3/2010 | Bank et al. |
| 9,041,662 | B2 | 5/2015 | Harris |
| 10,356,523 | B2 | 7/2019 | Harris |
| 10,631,089 | B2 | 4/2020 | Harris |
| 2002/0015507 | A1 | 2/2002 | Harris et al. |
| 2004/0061543 | A1 | 4/2004 | Nam et al. |
| 2010/0086151 | A1 | 4/2010 | Ruiter |
| 2015/0243874 | A1 | 8/2015 | East et al. |
| 2016/0277843 | A1 | 9/2016 | Babayoff et al. |
| 2019/0182590 | A1 | 6/2019 | Harris |
| 2020/0015009 | A1 | 1/2020 | Harris |

FOREIGN PATENT DOCUMENTS

| | | |
|---|---|---|
| CN | 103000801 | 3/2013 |
| JP | S59189800 | 10/1984 |
| JP | 2006116399 | 5/2006 |
| JP | 2012216905 | 11/2012 |
| KR | 1020080069225 | 7/2008 |
| WO | WO 2001/093628 | 12/2001 |
| WO | WO 2005/027571 | 3/2005 |
| WO | WO 2015/027571 | 3/2005 |
| WO | WO 2006/003367 | 1/2006 |

OTHER PUBLICATIONS

'Wikipedia.org' [online] "Distributed mode loudspeaker," Last Updated: Sep. 11, 2017, [retrieved on Oct. 31, 2017] Retrieved from Internet: URL<https://en.wikipedia.org/wiki/Distributed_mode_loudspeaker> 3 pages.

Belvins. "Formulas for natural frequency and mode shape: Table 8-1. Single Span Beams," Formulas for natural frequency and mode shape, Reprint Edition 2001, Originally published New York: Van Nostrand, 1979, 2 pages.

PCT International Search Report Appln No. PCT/GB2018/053617, dated Feb. 19, 2019, 18 pages.

PCT Written Opinion in International Appln. No. PCT/GB2018/053617, dated Nov. 6, 2019, 9 pages.

TW Office Action in Taiwan Appln. No. 107145054, dated Dec. 9, 2019, 15 pages (with machine translation).

KR Office Action in Korean Appln. No. 10-2019-7035122, dated Jul. 28, 2020, 20 pages (with English translation).

CN Office Action in Chinese Appln. No. 201880036111.4, dated Oct. 16, 2020, 34 pages (English translation).

KR Office Action in Korean Appln. No. 10-2019-7035122, dated Jan. 12, 2021, 8 pages (with English translation).

IN Office Action in Indian Appln. No. 201947048869, dated Mar. 24, 2021, 6 pages (with English translation).

KR Office Action in Korean Appln. No. 10-2019-7035122, dated Mar. 9, 2021, 9 pages (with English translation).

Device Side View

Panel Bottom View

Device Perspective View

DISTRIBUTED MODE LOUDSPEAKER ACTUATOR INCLUDING PATTERNED ELECTRODES

CROSS-REFERENCE TO RELATED APPLICATION

This is a continuation of U.S. application Ser. No. 16/510,740, filed on Jul. 12, 2019, which is a continuation of U.S. application Ser. No. 15/840,232, filed on Dec. 13, 2017, all of which are considered part of and are incorporated by reference in the disclosure of this application.

BACKGROUND

Some devices use a distributed mode loudspeaker ("DML") to generate sound. A DML is a speaker that creates sound by causing a panel to vibrate. A DML may use a distributed mode actuator ("DMA"), e.g., a piezoelectric transducer, to cause the panel to vibrate and generate sound instead of a voice coil actuator. For instance, a smartphone may include a DMA that applies force to a display panel (e.g., a LCD or an OLED panel) in the smartphone. The force creates vibrations of the display panel that couple to surrounding air to generate sound waves, e.g., in the range of 20 Hz to 20 kHz which may be audible to a human ear.

SUMMARY

A piezoelectric transducer in a distributed mode loudspeaker may include multiple electrode pairs used to generate sounds at different frequencies. For instance, the piezoelectric transducer may include a layer of a piezoelectric material, e.g., a piezoelectric ceramic material, that extends between each electrode pair. For example, the layer may have a first electrode from an electrode pair on top of the layer and a second electrode from the electrode pair below the layer.

The distributed mode loudspeaker includes a drive module that selectively energizes one or more of the multiple electrode pairs to generate a sound at a particular subset of frequencies within the range of frequencies at which the distributed mode loudspeaker can generate sounds. The drive module may provide current to one or more selected electrode pairs to cause a load, e.g., a display panel, connected to the distributed mode actuator, to generate the sound at the particular subset of frequencies.

In general, one innovative aspect of the subject matter described in this specification can be embodied in methods that include the actions of determining, for a piezoelectric transducer of a distributed mode loudspeaker adapted to create forces to cause vibration of a load to generate sound waves within a range of frequencies, a subset of frequencies, from the range of frequencies, at which to output a sound; selecting, based on the subset of frequencies, one or more electrode pairs from two or more electrode pairs included in the piezoelectric transducer to generate the sound, each electrode pair including a first electrode on a first side of a layer included in the piezoelectric transducer and a second electrode on a second side of the layer opposite the first side, and connected to a different portion of the layer; and providing, by a drive module connected to each of the two or more electrode pairs, current to each of the selected one or more electrode pairs to cause the piezoelectric transducer to generate a force that, when provided to a load, causes the load to generate the sound within the subset of frequencies. Other embodiments of this aspect include corresponding computer systems, apparatus, and computer programs recorded on one or more computer storage devices, each configured to perform the actions of the methods. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

In general, one innovative aspect of the subject matter described in this specification can be embodied in a system that includes a distributed mode loudspeaker including: a piezoelectric transducer: that includes two or more electrode pairs each of which a) include a first electrode on a first side of a layer included in the piezoelectric transducer, b) include a second electrode on a second side of the layer opposite the first side, and c) are connected to a different portion of the layer; and is adapted to create forces to cause vibration of a load to generate sound waves within a range of frequencies; a controller configured to: determine, for the piezoelectric transducer, a subset of frequencies, from the range of frequencies, at which to output a sound; and select, based on the subset of frequencies, one or more electrode pairs from the two or more electrode pairs included in the piezoelectric transducer to generate the sound; and a drive module: connected to each of the two or more electrode pairs and adapted to provide current to at least some of the two or more electrode pairs to cause the piezoelectric transducer to generate a force that, when provided to the load, causes the load to generate a sound; and configured to provide current to each of the selected one or more electrode pairs to cause the piezoelectric transducer to generate a force that, when provided to the load, causes the load to generate the sound within the subset of frequencies. Other embodiments of this aspect include corresponding computer systems, methods, and computer programs recorded on one or more computer storage devices, each configured to perform the actions of the operations. The computer system may include one or more computers and can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

In general, one innovative aspect of the subject matter described in this specification can be embodied in an apparatus that includes a smartphone including: a display configured to present content; a piezoelectric transducer: that includes two or more electrode pairs each of which a) include a first electrode on a first side of a layer included in the piezoelectric transducer, b) include a second electrode on a second side of the layer opposite the first side, and c) are connected to a different portion of the layer; and is adapted to create forces to cause vibration of a load to generate sound waves within a range of frequencies; a controller configured to: determine, for the piezoelectric transducer, a subset of frequencies, from the range of frequencies, at which to output a sound; and select, based on the subset of frequencies, one or more electrode pairs from the two or more electrode pairs included in the piezoelectric transducer to generate the sound; and a drive module: connected to each of the two or more electrode pairs and adapted to provide current to at least some of the two or more electrode pairs to cause the piezoelectric transducer to generate a force that, when provided to the load, causes the load to generate a sound; and configured to provide current to each of the selected one or more electrode pairs to cause the piezoelectric transducer to generate a force that, when provided to the load, causes the load to generate the sound within the subset of frequencies; one or more application processors configured to execute an application for the smartphone; and one or more memories one which are stored instructions that are operable, when executed by the one or more application processors, to cause the one or more application processors to execute the application. Other embodiments of this aspect include corresponding computer systems, methods, and computer programs recorded on one or more computer storage devices, each configured to perform the actions of the operations. The computer system may include one or more computers and can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

The foregoing and other embodiments can each optionally include one or more of the following features, alone or in combination. Selecting, based on the subset of frequencies, the one or more electrode pairs from the two or more electrode pairs included in the piezoelectric transducer to generate the sound may include selecting, based on the subset of frequencies, a subset of electrode pairs from the two or more electrode pairs. Determining the subset of frequencies, from the range of frequencies, at which to output the sound may include determining a high frequency range subset, from the range of frequencies, at which to output the sound. Selecting, based on the subset of frequencies, a subset of electrode pairs from the two or more electrode pairs may include selecting, based on the determined high frequency range subset, one electrode pair from the two or more electrode pairs. Selecting, based on the determined high frequency range subset, one electrode pair from the two or more electrode pairs may include selecting, based on the determined high frequency range subset, a particular electrode pair that is closest to a support a) fixedly connected to the piezoelectric transducer, b) connected to the load, and c) that transfers the force from the piezoelectric transducer to the load. The method may include determining a medium frequency range subset, from the range of frequencies, at which to output a second sound that is a different sound than the sound; selecting, based on the determined medium frequency range subset, two or more particular electrode pairs from three or more electrode pairs included in the piezoelectric transducer, the three or more electrode pairs including the two or more electrode pairs; and providing, by the drive module that is connected to each of the three or more electrode pairs, current to each of the selected two or more electrode pairs to cause the piezoelectric transducer to provide a force to the load and the load to generate the second sound within the medium frequency range subset.

In some implementations, selecting, based on the subset of frequencies, the one or more electrode pairs from the two or more electrode pairs included in the piezoelectric transducer to generate the sound may include selecting, based on the subset of frequencies, all of the two or more electrode pairs. Determining the subset of frequencies, from the range of frequencies, at which to output the sound may include determining a low frequency range subset, from the range of frequencies, at which to output the sound. Selecting, based on the subset of frequencies, all of the two or more electrode pairs may include selecting, based on the determined low frequency range subset, all of the two or more electrode pairs.

In some implementations, the system includes the load. The system may include a smartphone. The load may be a display of the smartphone, e.g., configured to present content. The display may present content to a user operating the smartphone. The distributed mode loudspeaker may include a support fixedly connected to the piezoelectric transducer that, when connected to the load, transfers at least some of the force generated by the piezoelectric transducer to the load. At least some electrode pairs from the two or more electrode pairs may share a common ground, have a separate ground. Some of the electrode pairs may share a common ground and some of the electrode pairs may have separate grounds. Each electrode pair from the two or more electrode pairs may have a separate ground. The layer may be ceramic.

Among other advantages, the systems and methods described below may reduce distributed mode loudspeaker power usage, increase impedance in distributed mode loudspeakers, reduce capacitance in distributed mode loudspeakers, or a combination of two or more of these.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1B:
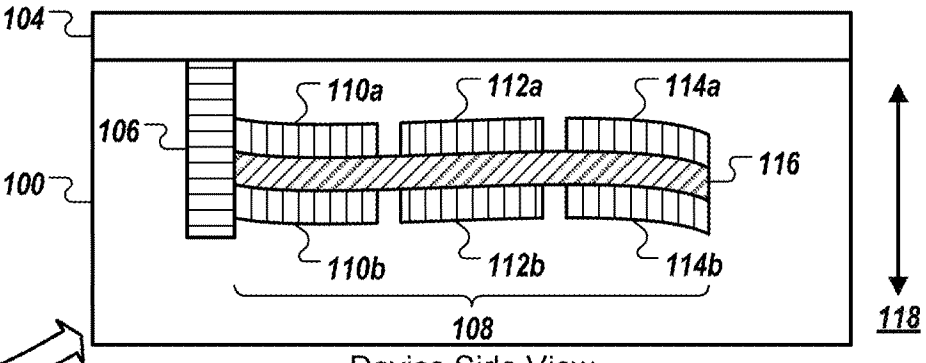
FIGS. 1A-C show an example device that includes a distributed mode loudspeaker.
Figure 1C:
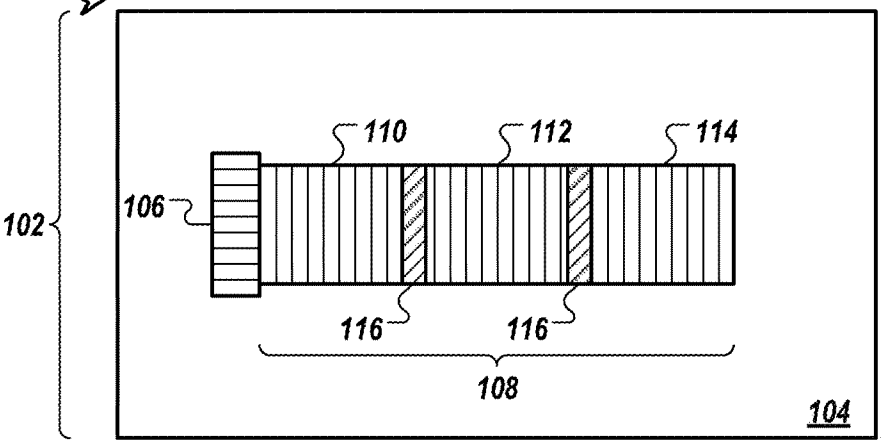
Figure 1A:
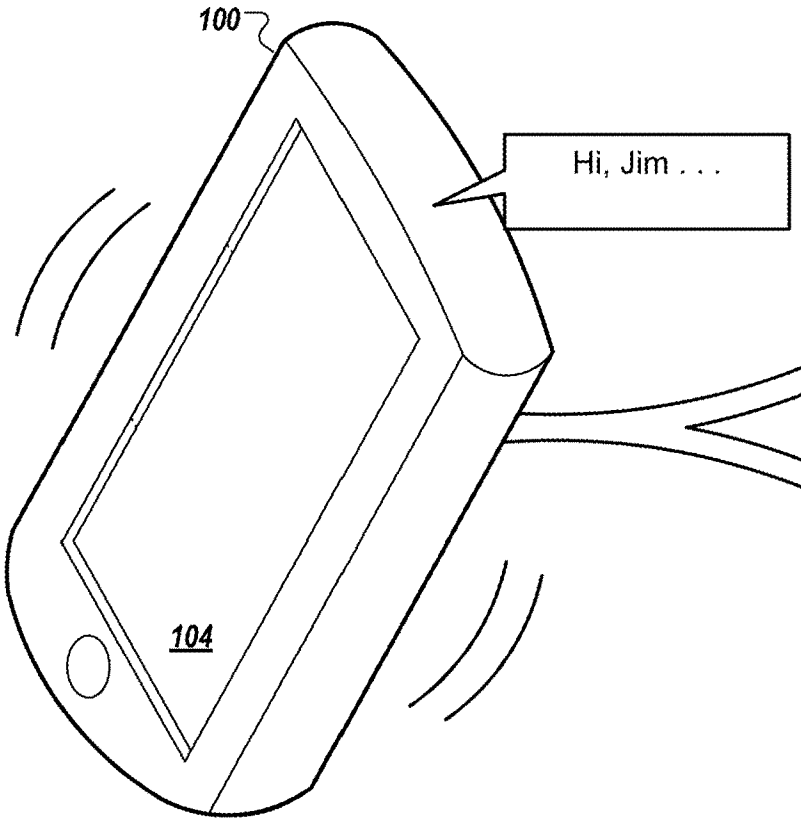

FIGS. 1A-C show an example device 100 that includes a distributed mode loudspeaker 102. The device 100, such as a smartphone or another type of computer, uses the distributed mode loudspeaker 102, shown in FIG. 1C, to generate sound. The sound may be any type of sound, such as a phone conversation, music, an audio stream, sound for a video, or sound for a game.

The distributed mode loudspeaker 102 includes a panel 104 that vibrates and generates sound waves. The panel 104 may be any appropriate panel included in the device 100 that can generate sound waves. For instance, the panel 104 may be a display panel included in the device 100. The display panel may include a touch screen or any other appropriate type of display.

The panel 104 is connected to a support 106, shown in FIGS. 1B-C, that transfers a force from a piezoelectric transducer 108 to the panel 104. The panel 104 is rigidly connected to the support 106 so that the support 106 can efficiently transfer force to the panel 104. In some implementations, the panel 104 may be removably connected to the support 106 during manufacturing of the device 100, e.g., the support 106 can be disconnected from the panel 104. In some examples, the panel 104 may be fixedly connected to the support 106, e.g., the support 106 is intended to be permanently fixed to the panel 104 without causing damage to remove the support 106 from the panel 104.

In some implementations, another component may be part of the connection between the panel 104 and the support 106. For example, the support 106 may rigidly connect to a chassis that rigidly connects to the panel 104.

The piezoelectric transducer 108 is connected to the support 106 to allow transfer of at least some of a force, generated by the piezoelectric transducer 108, from the piezoelectric transducer 108, through the support 106, and into the panel 104. The piezoelectric transducer 108 is rigidly connected to the support 106 so that the piezoelectric transducer 108 can efficiently transfer force to the support 106. In some examples, the piezoelectric transducer 108 is fixedly connected to the support 106, e.g., permanently fixed to the support 106 such that removal would cause damage to the support 106, the piezoelectric transducer 108, or both. The piezoelectric transducer 108 may be removably connected to the support 106, e.g., such that the piezoelectric transducer 108 may be disconnected from the support 106 without causing damage to either.

The piezoelectric transducer 108 generates the force by actuating in response to receipt of a signal from a drive module included in the distributed mode loudspeaker 102. For instance, the piezoelectric transducer 108 includes multiple electrode pairs 110-114 each of which is connected to the drive module to allow the corresponding electrode pair 110-114 to receive an activation signal, e.g., current, from the drive module. When an electrode pair 110-114 receives a signal from the drive module, the electrode pair 110-114 produces an electric field across at least a portion of a layer 116 of piezoelectric material of the piezoelectric transducer 108. The electric field causes a physical change in dimension of the piezoelectric material, and the associated displacement of the actuator generates a force.

The electrode pairs 110-114 may be connected to the layer 116 in any appropriate manner. For instance, the electrode pairs 110-114 may be fixedly connected to the layer 116 during manufacturing, e.g., through a deposition and patterning process. The electrode pairs 110-114 may include separate grounds. For example, the electrodes 110*a*, 112*a*, and 114*a* may be positive electrodes each of which has a corresponding ground electrode 110*b*, 112*b*, and 114*b*, respectively. The piezoelectric transducer 108 may include any appropriate combination of positive electrodes and ground electrodes. For instance, the electrodes 110*a*, 112*b*, and 114*b* may be positive electrodes while the other electrodes 110*b*, 112*a*, and 114*a* are ground electrodes. In some examples, the electrode pairs 110-114 may include a common ground. For example, the electrodes 110*a*, 112*a*, and 114*a* may be positive electrodes and the electrodes 110*b*, 112*b*, and 114*b* may be a single common ground electrode.

The layer 116 may be any appropriate type of piezoelectric material. For instance, the layer 116 may be a ceramic or crystalline piezoelectric material. Examples of ceramic piezoelectric materials include barium titanate, lead zirconium titanate, bismuth ferrite, and sodium niobate, for example. Examples of crystalline piezoelectric materials include topaz, lead titanate, lithium niobate, and lithium tantalite.

The actuation of the layer 116 by the electrode pairs 110-114 may be movement of a portion of the layer 116 in a vertical direction 118 perpendicular to a large surface of the layer 116. Different portions of the layer 116 actuate separately depending on the electrode pairs 110-114 that receive a signal from the drive module. For instance, when a first electrode pair 110*a-b* receives a signal from the drive module, the first electrode pair 110*a-b* may primarily cause a portion of the layer 116 that is closest to the support 106, and connected to the first electrode pair 110*a-b*, to actuate. When a second electrode pair 112*a-b* receives a signal from the drive module, the second electrode pair 112*a-b* may primarily cause a middle portion of the layer 116, connected to the second electrode pair 112*a-b*, to actuate. When a third electrode pair 114*a-b* receives a signal from the drive module, the third electrode pair 114*a-b* may primarily cause an end portion of the layer 116 that is farthest away from the support 106, and connected to the third electrode pair 114*a-b*, to actuate.

In some implementations, the various electrode pairs 110-114 primarily cause a respective portion of the layer 116 to actuate in response to receiving a signal because adjacent portions of the layer 116 may also actuate to a lesser degree than the respective portion of the layer 116 to which the electrode pair is connected. For example, when the first electrode pair 110*a-b* receives a signal from the drive module, the first electrode pair 110*a-b* primarily causes the portion of the layer 116 connected to the first electrode pair 110*a-b* to actuate and generate a force and may also cause some of the portion of the layer 116 connected to the second electrode pair 112*a-b* to actuate.

The distributed mode loudspeaker 102 includes multiple electrodes to allow separate selection, energization, or both, of different portions of the layer 116. For instance, the distributed mode loudspeaker 102 may selectively energize some of the electrodes for better reproduction of sounds at certain frequencies, to reduce power consumption, or both.

Figure 2A:
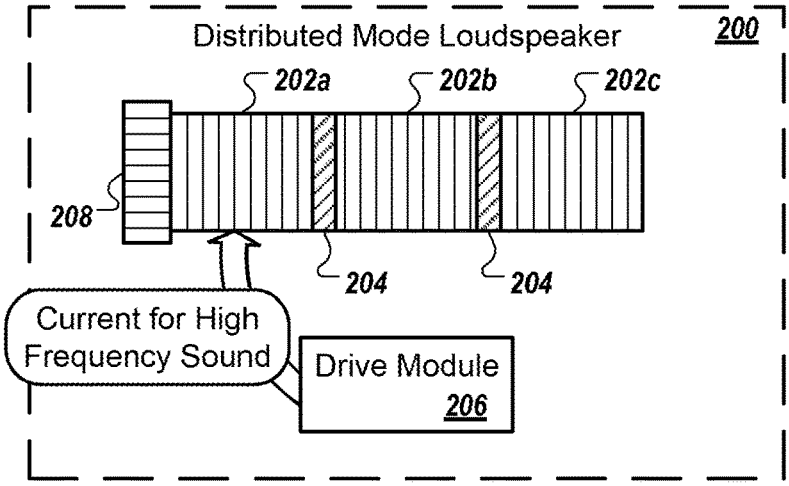
FIGS. 2A-C show a distributed mode loudspeaker separately energizing electrode pairs to actuate a transducer layer based on an output frequency subset.
Figure 2B:
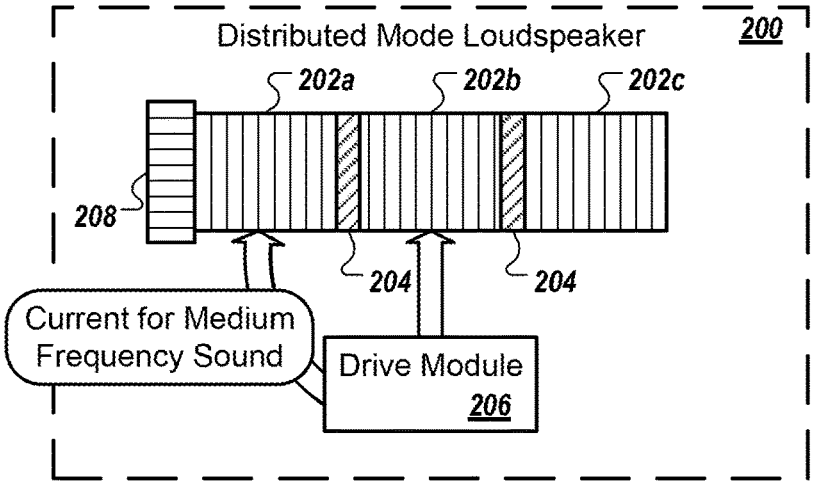
Figure 2C:
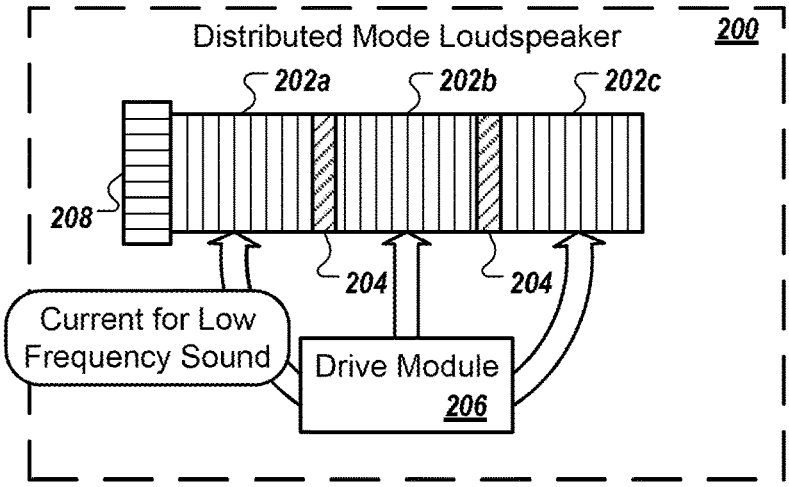

FIGS. 2A-C show a distributed mode loudspeaker 200 separately energizing electrode pairs 202*a-c* to actuate a transducer layer 204 based on an output frequency subset. The distributed mode loudspeaker 200 may be an example of the distributed mode loudspeaker 102 discussed with reference to FIG. 1. The electrode pairs 202*a-c* may correspond to the electrode pairs 110-114. The transducer layer 204 may correspond to the layer 116. The support 208 may correspond to the support 106.

A drive module 206, included in the distributed mode loudspeaker 200, may energize only some of the electrode pairs 202*a-c* when generating high frequency sounds, as shown in FIG. 2A. In some examples, the drive module 206 may energize a first electrode pair 202*a* for high frequency sound generation. The first electrode pair 202 may be closest to a support to which a piezoelectric transducer, that includes the electrodes 202*a-c* and the transducer layer 204, is connected. The drive module 206 may energize only some of the electrode pairs 202*a-c* to reduce power consumption when generating sound.

The drive module 206 may energize multiple electrode pairs 202*a-b* to generate medium frequency sounds, as shown in FIG. 2B. The multiple electrode pairs 202*a-b* may include two or more electrode pairs. The multiple electrode pairs 202*a-b* may include fewer than all of the electrode pairs 202*a-c* included in the distributed mode loudspeaker 200. In some examples, the drive module 206 may select and energize adjacent electrode pairs, e.g., two electrode pairs 202*a-b* closest to the support or two electrode pairs 202*b-c* furthest from the support 208, to generate a medium frequency sound. In some examples, the drive module 206 may select and energize two electrode pairs that are not adjacent to each other, e.g., a first electrode pair 202*a* and a third electrode pair 202*c*.

The drive module 206 may energize multiple electrode pairs 202*a-c* to generate low frequency sounds, as shown in FIG. 2C. The multiple electrode pairs 202*a-c* may include three or more electrode pairs. For example, the drive module 206 may select and energize all of the electrode pairs 202*a-c* included in the distributed mode loudspeaker 200 to generate a low frequency sound. The drive module 206 may select multiple electrode pairs 202*a-c* for more accurate reproduction of low frequency sounds by the distributed mode loudspeaker 200, e.g., to reproduce a wider range of low frequency sounds.

Figure 3:
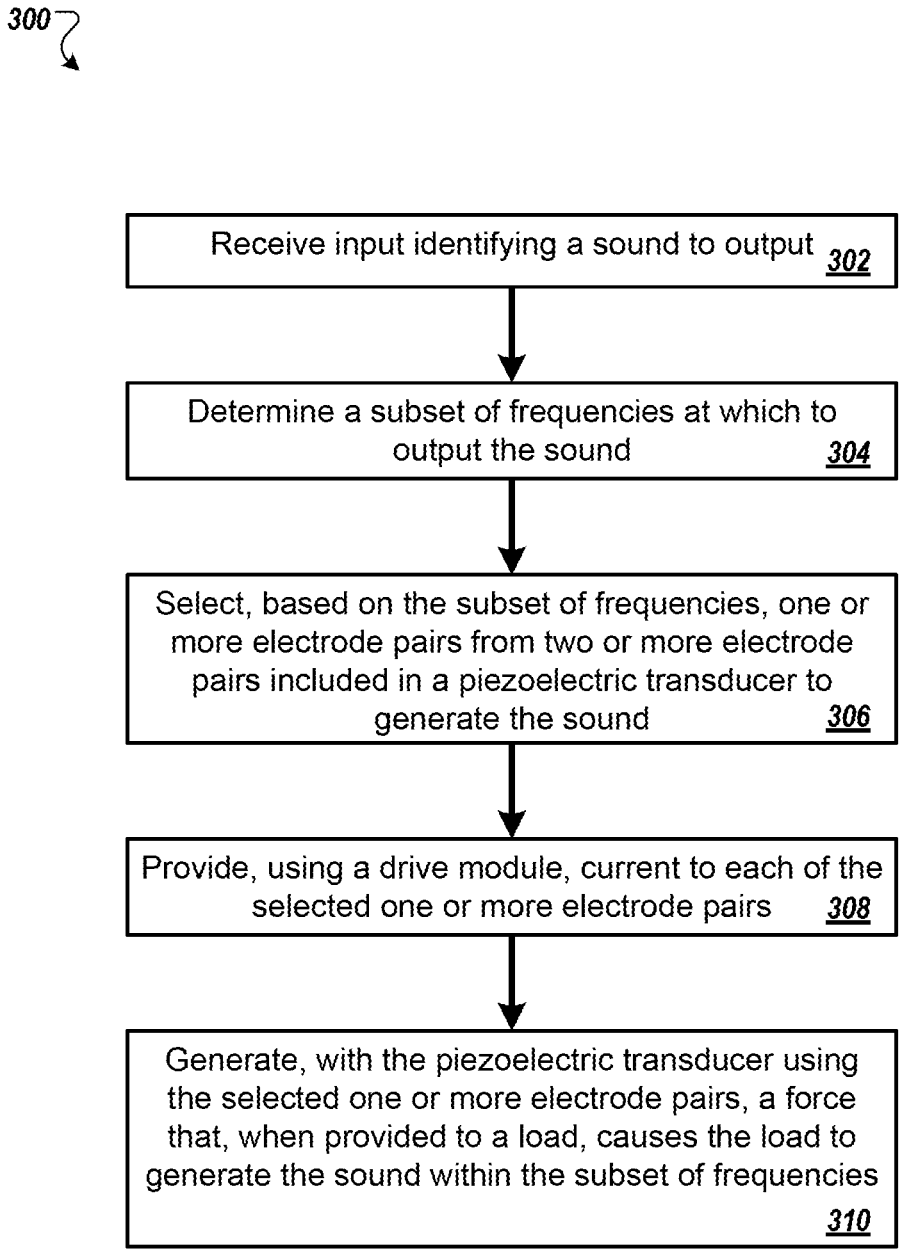
FIG. 3 is a flow diagram of a process for providing current to a subset of two or more electrode pairs included in a piezoelectric transducer.

FIG. 3 is a flow diagram of a process 300 for providing current to a subset of two or more electrode pairs included in a piezoelectric transducer. For example, the process 300 can be used by the distributed mode loudspeaker 102 from the device 100.

A distributed mode loudspeaker receives input identifying a sound to output (302). For example, a drive module or a controller, included in the distributed mode loudspeaker, may receive a signal that identifies the sound to output. The signal may be any appropriate type of signal for a speaker, a distributed mode loudspeaker, or both. The drive module or the controller may receive the input from an application executing on a device, e.g., a phone or music application on a smartphone. The drive module may be the same component in the distributed mode loudspeaker as the controller. In some examples, the drive module may be a different component than the controller in the distributed mode loudspeaker.

The distributed mode loudspeaker is configured to generate sound waves within a range of frequencies. For example, the manufacturing design of the distributed mode loudspeaker, potentially including configuration parameters for a panel, a support, and a piezoelectric transducer, all of which are included in the distributed mode loudspeaker, may correspond to the range of frequencies at which the distributed mode loudspeaker can generate sounds.

The distributed mode loudspeaker determines a subset of frequencies at which to output the sound (304). The subset of frequencies is a subset of frequencies from the range of frequencies at which the distributed mode loudspeaker can generate sounds. The subset of frequencies may be a proper subset of the range of frequencies at which the distributed mode loudspeaker can generate sounds. The drive module or the controller may use data from the signal to determine the subset of frequencies. For instance, the drive module or the controller may determine that the signal identifies the subset of frequencies at which to output the sound.

The distributed mode loudspeaker selects, based on the subset of frequencies, one or more electrode pairs from two or more electrode pairs included in a piezoelectric transducer to generate the sound (306). The drive module or the controller may use any appropriate method to select the one or more electrode pairs based on the subset of frequencies. In some examples, the drive module or the controller may use an algorithm that outputs, for a subset of frequencies, a number of electrode pairs to energize, identifiers for electrode pairs to energize, or both, to generate the sound. For instance, the drive module or the controller may use a mapping of frequency subset ranges, from the range of frequencies, to input values when selecting the one or more electrode pairs from the two or more electrode pairs included in the piezoelectric transducer.

In some examples, when the controller is a different component from the drive module and determines the subset of frequencies, the controller provides data for the subset of frequencies to the drive module. For instance, the controller that determines the subset of frequencies at which to output the sound and provides data for the subset of frequencies to the drive module. The data for the subset of frequencies may be data that identifies the subset of frequencies, e.g., data representing numerical values for the subset of frequencies. In response to receiving the data for the subset of frequencies, the drive module uses the data for the subset of frequencies to select the one or more electrode pairs included in the piezoelectric transducer to generate the sound.

The distributed mode loudspeaker includes the piezoelectric transducer. The distributed mode loudspeaker may include any appropriate number of electrode pairs greater than or equal to two. For example, the distributed mode loudspeaker may include two, three, four, five, six, or nine electrode pairs.

The distributed mode loudspeaker provides, using a drive module, current to each of the selected one or more electrode pairs (308). For example, the drive module provides the current to the positive electrodes from the selected one or more electrode pairs. When at least some of the electrode pairs share a common ground, the drive module provides input current to the separate positive electrodes, each of which is from one of the electrode pairs, and the distributed mode loudspeaker receives output current from the electrode pairs through the common ground. When the electrode pairs have separate ground electrodes, the distributed mode loudspeaker receives the output current from the separate ground electrodes, from the selected one or more electrode pairs, based on providing input current to the separate positive electrodes from the selected one or more electrode pairs.

The distributed mode loudspeaker generates, with the piezoelectric transducer using the selected one or more electrode pairs, a force that, when provided to a load, causes the load to generate the sound within the subset of frequencies (310). For instance, receipt of the current by the electrode pairs causes a layer, included in the piezoelectric transducer, to actuate and generate a force. A support, included in the distributed mode loudspeaker, may transfer the force, or at least a portion of the force, from the piezoelectric transducer to a panel. Receipt of the force or the portion of the force by the panel causes the panel to vibrate and generate the sound identified by the input.

In some implementations, the process 300 can include additional steps, fewer steps, or some of the steps can be divided into multiple steps. For example, the distributed mode loudspeaker may determine a subset of frequencies at which to output a sound and select one or more electrode pairs to generate the sound without performing the other steps in the process 300. In some examples, the distributed mode loudspeaker may perform steps 304, 306, and 308 without performing the other steps in the process 300.

One or more of the steps in the process 300 may be performed automatically in response to a prior step in the process 300. For example, the distributed mode loudspeaker may determine the subset of frequencies in response to receiving the input. The distributed mode loudspeaker may select the one or more electrode pairs from the two or more electrode pairs included in the piezoelectric transducer in response to determining the subset of frequencies. The drive module may provide current to each of the selected one or more electrode pairs in response to selecting the one or more electrode pairs. The piezoelectric transducer may generate the force in response to receiving the current from the drive module.

In some implementations, when the distributed mode loudspeaker is included in a smartphone, the smartphone may include a display, e.g., a display panel, one or more processors, and one or more memories. The display may be a load used by the distributed mode loudspeaker to generate sound. In some examples, the smartphone may include a load different from the display for the distributed mode loudspeaker to use when generating a sound.

The memories may store instructions for an application, e.g., from which the distributed mode loudspeaker receives the input identifying the sound to output. The one or more processors, e.g., one or more application processors, may use the instructions stored on the one or more memories to execute the application. During execution of the application, e.g., a phone application or a music application or a game, the application may determine a sound to output to a user. The application provides, to the distributed mode loudspeaker, data for the sound.

The controller or the drive module in the distributed mode loudspeaker receive the data for the sound as input. The controller may be the same component in the smartphone. In some examples, the controller is a different component in the smartphone from the drive module. The controller, the drive module, or a combination of the two, use the data for the sound to determine the subset of frequencies, select the one or more electrode pairs, and provide current to the selected one or more electrode pairs.

In some examples, the one or more processors, the one or more memories, or both, are separate from the drive module, the controller, or both. For example, the controller, the drive module, or both, may include at least one processor, at least one memory, or both. The at least one processor may be a different set of processors from the one or more processors. The at least one memory may be a different memory from the one or more memories.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non-transitory program carrier for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. The computer storage medium can be a machine-readable storage device, a machine-readable storage substrate, a random or serial access memory device, or a combination of one or more of them.

The term "data processing apparatus" refers to data processing hardware and encompasses all kinds of apparatus, devices, and machines for processing data, including by way of example a programmable processor, or multiple processors. The apparatus can also be or further include special purpose logic circuitry, e.g., an FPGA (field programmable gate array) or an ASIC (application-specific integrated circuit). The apparatus can optionally include, in addition to hardware, code that creates an execution environment for computer programs, e.g., code that constitutes processor firmware, a protocol stack, an operating system, or a combination of one or more of them.

For example, a distributed mode loudspeaker, e.g., a drive module or a controller or both, may include a data processing apparatus. The distributed mode loudspeaker may use the data processing apparatus, in conjunction with at least one memory, to perform one or more of the operations described in this document.

A computer program, which may also be referred to or described as a program, software, a software application, a module, a software module, a script, or code, can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub-programs, or portions of code. A computer program can be deployed to be executed on one computer or on multiple computers that are located at one site or distributed across multiple sites and interconnected by a communication network.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Computers suitable for the execution of a computer program include, by way of example, general or special purpose microprocessors or both, or any other kind of central processing unit. Generally, a central processing unit will receive instructions and data from a read-only memory or a random access memory or both. The essential elements of a computer are a central processing unit for performing or executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device, e.g., a universal serial bus (USB) flash drive, to name just a few.

Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

A distributed mode loudspeaker may include one or more memories that store instructions which, when executed by the distributed mode loudspeaker, cause the distributed mode loudspeaker to perform one or more operations described in this document. For instance, the instructions may cause the distributed mode loudspeaker to determine an output frequency subset, energize one or more electrodes, or both. In some examples, the drive module or the controller or both may include the one or more memories or some of the one or more memories.

To provide for interaction with a user, embodiments of the subject matter described in this specification can be implemented on a computer having a display device, e.g., an LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's device in response to requests received from the web browser.

While this specification contains many specific implementation details, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

What is claimed is:

1. A distributed mode loudspeaker comprising:

a display panel; and an actuator coupled to the display panel, the actuator comprising:

a support attached to the display panel; and a beam comprising a layer of piezoelectric material, the beam being attached to the support at one end and extending parallel to the display panel to a free end opposite the end attached to the support, the beam further comprising electrode layers arranged on opposing sides of the layer of piezoelectric material, the electrode layers comprising two or more electrode pairs, each electrode pair comprising a first electrode on a first side of the opposing sides and a second electrode on a second side of the opposing sides; and a drive module connected to each of the two or more electrode pairs and adapted to selectively provide current to the actuator to generate a force that, when provided to the display panel, causes the display panel to generate sound waves.

2. The distributed mode loudspeaker of claim 1, wherein at least some electrode pairs from the two or more electrode pairs share a common ground.

3. The distributed mode loudspeaker of claim 1, wherein each electrode pair from the two or more electrode pairs has a separate ground.

4. The distributed mode loudspeaker of claim 1, wherein the layer of piezoelectric material comprises ceramic.

5. A smartphone, comprising:

the distributed mode loudspeaker of claim 1; and a controller configured to:

determine, for the actuator, the subset of frequencies from a range of frequencies at which the display panel generates sound; and select, based on the subset of frequencies, one or more electrode pairs from the two or more electrode pairs included in the beam to generate the sound.

6. The smartphone of claim 5, wherein the controller is configured to select, based on the subset of frequencies, the one or more of the electrode pairs to generate the sound by selecting, based on the subset of frequencies, a subset of electrode pairs from the two or more electrode pairs.

7. The smartphone of claim 6, wherein the controller is configured to:

determine the subset of frequencies, from the range of frequencies, at which to output the sound by determining a high frequency range subset, from the range of frequencies, at which to output the sound; and select, based on the subset of frequencies, a subset of electrode pairs from the two or more electrode pairs by selecting, based on the determined high frequency range subset, one electrode pair from the two or more electrode pairs.

8. The distributed mode loudspeaker of claim 7, wherein the controller is configured to select, based on the determined high frequency range subset, one electrode pair from the two or more electrode pairs by selecting, based on the determined high frequency range subset, a particular electrode pair that is closest to the support.

9. The smartphone of claim 7, wherein the controller is configured to:

determine a medium frequency range subset, from the range of frequencies, at which to output a second sound that is a different sound than the sound; and select, based on the determined medium frequency range subset, two or more particular electrode pairs from three or more of the electrode pairs, the three or more electrode pairs comprising the two or more electrode pairs; and the drive module is configured to provide, by the drive module that is connected to each of the three or more electrode pairs, current to each of the selected two or more electrode pairs to cause the actuator to provide a force to the display panel and the display panel to generate the second sound within the medium frequency range subset.

10. The smartphone of claim 5, wherein the controller is configured to select, based on the subset of frequencies, the one or more electrode pairs from the two or more electrode pairs to generate the sound by selecting, based on the subset of frequencies, all of the two or more electrode pairs.

11. The smartphone of claim 10, wherein the controller is configured to:

determine the subset of frequencies, from the range of frequencies, at which to output the sound by determining a low frequency range subset, from the range of frequencies, at which to output the sound; and select, based on the subset of frequencies, all of the two or more electrode pairs by selecting, based on the determined low frequency range subset, all of the two or more electrode pairs.

12. A method comprising:

determining, for an actuator of a distributed mode loudspeaker adapted to create forces to cause vibration of a display panel to generate sound waves, frequencies at which to output a sound, the actuator comprising a beam spaced apart from the display panel and extending parallel to the display panel, the beam comprising a piezoelectric material;

selecting, based on the frequencies, one or more electrode pairs from two or more electrode pairs supported by the beam, each electrode pair comprising a first electrode on a first side of the beam and a second electrode on a second side of the beam opposite the first side; and providing, by a drive module connected to each of the two or more electrode pairs, current to each of the selected one or more electrode pairs to cause the actuator to generate a force that, when coupled to the display panel, causes the display panel to generate the sound.

13. The method of claim 12, wherein selecting the one or more electrode pairs from the two or more electrode pairs to generate the sound comprises selecting a subset of electrode pairs from the two or more electrode pairs.

14. The method of claim 13, wherein:

determining a subset of frequencies at which to output the sound comprises determining a high frequency range subset from a range of frequencies at which the distributed mode loudspeaker can emit sound, at which to output the sound; and selecting, based on the subset of frequencies, a subset of electrode pairs from the two or more electrode pairs comprises selecting, based on the determined high frequency range subset, one electrode pair from the two or more electrode pairs.

15. The method of claim 14, wherein selecting, based on the determined high frequency range subset, one electrode pair from the two or more electrode pairs comprises selecting, based on the determined high frequency range subset, a particular electrode pair that is closest to a support connecting the beam to the display panel.

16. The method of claim 14, further comprising:

determining a medium frequency range subset, from the range of frequencies, at which to output a second sound that is a different sound than the sound;

selecting, based on the determined medium frequency range subset, two or more particular electrode pairs from three or more electrode pairs included in the actuator, the three or more electrode pairs comprising the two or more electrode pairs; and providing, by the drive module that is connected to each of the three or more electrode pairs, current to each of the selected two or more electrode pairs to cause the actuator to provide a force to the display panel and the display panel to generate the second sound within the medium frequency range subset.

* * * * *